US005221321A

United States Patent [19]

Lim

[11] Patent Number: 5,221,321

[45] Date of Patent: Jun. 22, 1993

[54] FE-BASE SINTERED ALLOY FOR VALVE SEATS FOR USE IN INTERNAL COMBUSTION ENGINES

[75] Inventor: Jong Dae Lim, Kyungnam, Rep. of Korea

[73] Assignee: Hyundai Motor Company, Seoul, Rep. of Korea

[21] Appl. No.: 716,916

[22] Filed: Jun. 18, 1991

[30] Foreign Application Priority Data

Jan. 30, 1990 Rep. of Korea ..... 90-1017

[51] Int. Cl.[5] ..... C22C 38/00; C22C 33/02

[52] U.S. Cl. ..... 75/246; 75/243; 419/11; 419/38; 419/53; 419/55

[58] Field of Search ..... 75/243, 246; 419/11, 419/38, 53, 55

[56] References Cited

U.S. PATENT DOCUMENTS

| | | | |
|---|---|---|---|
| 3,856,478 | 12/1974 | Iwata et al. | 29/182 |
| 3,982,905 | 9/1976 | Osawa et al. | 29/182.5 |
| 4,345,943 | 8/1982 | Tabahashi et al. | 75/238 |
| 4,348,232 | 9/1982 | Hiraoka et al. | 75/238 |
| 4,505,988 | 3/1985 | Urano et al. | 428/569 |
| 4,546,737 | 10/1985 | Kazuoka et al. | 123/188 |
| 4,632,074 | 12/1986 | Takahashi et al. | 123/90.39 |
| 4,671,491 | 6/1987 | Kuroishi et al. | 251/368 |
| 4,734,968 | 4/1988 | Kuroishi et al. | 29/156.7 |
| 4,836,848 | 6/1989 | Mayama et al. | 75/231 |

FOREIGN PATENT DOCUMENTS

| | | |
|---|---|---|
| 56-3654 | 1/1981 | Japan . |
| 56-20143 | 2/1981 | Japan . |
| 63-100206 | 5/1988 | Japan . |
| 89-3408 | 9/1989 | Rep. of Korea . |
| 90-6700 | 9/1990 | Rep. of Korea . |

*Primary Examiner*—Donald P. Walsh
*Assistant Examiner*—Ngoclan T. Mai
*Attorney, Agent, or Firm*—Birch, Stewart, Kolasch & Birch

[57] ABSTRACT

A Fe-base sintered alloy for a valve seat for use in internal combustion engines, which constitutes a chemical composition of 0.4 to 2% of C, 0.5 to 5% of Cr, 5 to 15% of Mo, 0.2 to 2% of Ni, 0.4 to 2% of Co, 8 to 20% of Cu, 0.01 to 0.5% of S, and the balance Fe, wherein percentages are by weight. The Fe-base sintered alloy possesses high strength and high rigidity, and hence exhibits excellent abrasive and corrosion wear resistance properties, as well as excellent lubricity.

4 Claims, No Drawings

FE-BASE SINTERED ALLOY FOR VALVE SEATS FOR USE IN INTERNAL COMBUSTION ENGINES

BACKGROUND OF THE INVENTION

1. Field of the Invention

The present invention relates to a Fe-base sintered alloy for valve seats for use in internal combustion engines and more particularly, to an improved Fe-base sintered alloy for valve seats, which possesses a high strength and a high rigidity and hence exhibits an excellent abrasive wear resistance and an excellent corrosion wear resistance, and an excellent lubricity.

2. Description of the Prior Art

There are many kinds of sintered alloys for valve seats for use in internal combustion engines known in the art.

In general, the valve seats can be easily abraded and corroded in internal combustion engines especially, without lubricant and at elevated temperatures. Furthermore, the valve seats can be more easily abraded and corroded in engines which use gasoline containing 1.5 g of Pb per gallon and have multiple valves such as 3-valve, 4-valve, and 6-valve engines.

Thus, when the gasoline containing Pb is utilized in the engines, even though PbO is generated by the combustion of the gasoline functions as a lubricant, if deposits or sludges of Pb compound are disposed excessively around the valve, the heat conduction of the valves through valve seats is obstructed by deposits. Therefore the valve seats can be experienced corrosion wear resistance acceleratly because the valves and the valve seats become over-heated.

Especially for multi-valve engines, even though gasoline does not contain Pb, the valve seats can be readily softened and abraded accelerately at elevated temperature because the valve seats are located nearer one another compared with 2-valve engine.

Thus, generally, the valve seats for internal combustion engines are required to have high wear resistance properties not only at room temperature but also at elevated temperatures, high creep strength properties, and high thermal fatigue strength under repeated impact loadings at elevated temperature.

Such sintered alloy products for valve seats are shown in U.S. Pat. No. 3,982,905 to Osawa et al, U.S. Pat. No. 4,505,988 to Urano et al, U.S. Pat. No. 4,546,737 to Kazuoka et al, U.S. Pat. No. 4,671,491 to Kuroshi et al, U.S. Pat. No. 4,734,968 to Kuroshi et al, U.S. Pat. No. 4,836,848 to Hayama et al, Korean Pat. Publication 89-3408, Korean Pat. Publication 90-6,700, Japanese Pat. Laid Open 56-249, Japanese Pat. Laid Open 56-3654, and Japanese Pat. Laid Open 63-100,206.

However, the conventional valve seats for internal combustion engines generally do not possess desired high strength, high rigidity, excellent abrasion and corrosion resistance properties. Also, the density of several conventional valve seats is too low and hence the seats are too porous and do not provide a valve seat with a satisfactory strength.

SUMMARY OF THE INVENTION

Accordingly, it is an object of the present invention to provide an improved Fe-base sintered alloy for valve seats for internal combustion engines, which eliminates the above problems encountered in conventional valve seats.

Another object of the present invention is to provide a sintered alloy for valve seats which constitutes a chemical composition of 0.4 to 2% of C, 0.5 to 5% of Cr, 5 to 15% of Mo, 0.2 to 2% of Ni, 0.4 to 2% of Co, 8 to 20% of Cu, 0.01 to 0.5% of S, and the balance Fe, wherein the percentages are by weight.

A further object of the present invention is to provide a Fe-base sintered alloy for valve seats for use in internal combustion engines, which possesses high strength and high rigidity, and hence exhibits excellent abrasion and corrosion resistance properties, as well as excellent lubricity.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a Fe-base sintered alloy for a valve seat for use in internal combustion engines, which constitutes a chemical composition of 0.4 to 2% of C, 0.5 to 5% of Cr, 5 to 15% of Mo, 0.2 to 2% of Ni, 0.4 to 2% of Co, 8 to 20% of Cu, 0.01 to 0.5% of S, and the balance Fe, wherein the percentages are by weight so that the Fe-base sintered alloy possesses high strength and high rigidity, and hence exhibits excellent abrasion and corrosion resistance properties, as well as excellent lubricity.

DESCRIPTION OF THE PREFERRED EMBODIMENTS

Referring now in detail to the drawings for the purpose of ting preferred embodiments of the present invention, the Fe-base sintered alloy for a valve seat for use in internal combustion engines constitutes a chemical composition of 0.4 to 2% of C, 0.5 to 5% of Cr, 5 to 15% of Mo, 0.2 to 2% of Ni, 0.4 to 2% of Co, 8 to 20% of Cu, 0.01 to 0.5% of S, and the balance Fe, wherein percentages are by weight, so that the Fe-base sintered alloy possesses high strength and high rigidity, and hence exhibits excellent abrasion and corrosion resistance properties, as well as excellent lubricity.

Preferred materials for the Fe-base sintered alloy for the valve seat of the present invention are as follows.

The carbon (C) compound is preferably derived from raw graphite powder, and the chromium (Cr) compound is preferably derived from Fe-Cr alloy powder such as, for example, alloy powder containing 12% of Cr by weight. The molybdenum (Mo) compound is preferably from a Mo metallic powder, Fe-Mo alloy powder, or mixture of 20 to 30% of Mo metallic powder and 70–80% of Fe-Mo powder. The nickel (Ni) and cobalt (Co) are preferably from Ni metallic powder and Co metallic powder, respectively. The copper (Cu) compound is preferably from Cu infiltration powder having 3 to 5% of Cu by weight. The sulfur (S) compound is preferably from Fe-S alloy powder having 0.7 to 1% of S by weight.

An exemplative process for the preparation of the Fe-base sintered alloy for a valve seat for use in internal combustion engines includes mixing the above alloy powders in the above described content ranges to produce a powder mixture, compacting the resulting powder mixture under a pressure of $6t/cm^2$ to produce a resultant compact mixture, sintering the produced compact at a temperature of 1,000° to 1,200° C. in a hydrogen atmosphere for 60 to 120 minutes to sinter the compact mixture, infiltrating the sintered product at a temperature 1,000° to 1,200° C. under a nitrogen atmosphere for 15 to 30 minutes, heating the sintered product again at a temperature of 850° to 900° C. for 20 minutes to 1 hour and cooling it in oil, and heating the cooled product again at a temperature of 550° to 700° C. for 1 to 2 hours and then cooling it in an air atmosphere.

The reasons why the sintered alloy composition of the present invention may be used for a valve seat in internal combustion engines are as follows.

First of all, 0.4 to 2% by weight of C provides strength to the matrix for the valve seat as well as the fact that C forms carbides with Cr and Mo so as to exhibit abrasion resistance. If the content of C is less than 0.4% or more than 2% by weight, these additives exhibit no recognizable effect.

Also, the amount of 0.5 to 5% by weight of Cr allows for the formation of carbides with C which possess both abrasion resistance and heat resistance properties. If the content of Cr is less than 0.5% or more than 5% by weight, these additives exhibit no recognizable effect and furthermore, reduce the rigidity of the alloy.

Mo may be added to the matrix in a metallic state for increasing heat resistance and abrasive wear resistance. If the content of Mo is less than 5% or more than 15% by weight, this additive does not exhibit a recognizable effect and may abrade the valve.

Ni is added to the matrix to provide high strength and heat resistance. If the content of Ni is less than 0.2% by weight, this additive exhibits no recognizable effect and if the content of Ni is more than 2%, the resulting alloy is uneconomical.

Also, Co is added to the matrix for increasing the strength and heat resistance. If the content of Co is less than 0.4%, this additive exhibits no recognizable effect and if it is present in more than 2%, it is uneconomical.

Cu strengthens the matrix, increase heat conductibility, and increases abrasive wear resistance when using gasoline containing Pb copper infiltration is preferably carried out so as to close a plurality of porosity in the Fe base matrix. If the content of Cu is less than 8%, the addition does not have infiltration function. If it is present in more than 20% by weight, the Cu can overflow from the matrix.

S forms metallic sulfides which exhibit self lubricity and corrosion resistance. If the addition of sulfur is less than 0.02%, it exhibits no recognizable effect and if it is present in more than 2%, the matrix does not possess a strength as high as desired.

Thus, the Fe-base sintered alloy of the present invention possesses good qualities such as, for example, as absence of porosity, about 60 to 65% improved strength over that of a conventional alloy, and about 300 to 350% improved abrasive wear resistance over that of a conventional alloy. Accordingly, the Fe-base sintered alloy of the present invention can be utilized for valve seats in many internal combustion engines.

The present invention will now be described in more detail in connection with the following examples which should be considered as being exemplary and not limiting the present invention.

EXAMPLE 1-5

Raw materials used for the alloy were chosen as shown in Table 1. The powder mixtures were compacted under the pressure of 6 T/cm$^2$ and sintered at a temperature of 1,120° C. for 60 minutes.

Cu was put on the sintered matrix and heated to a temperature of 1,100° C. for 20 minutes to conduct Cu infiltration under a nitrogen atmosphere. The sintered matrix was maintained at a temperature of 860° C. for 30 minutes and was cooled in oil. Thereafter the sintered matrix was heated to a temperature of 600° C. for 90 minutes and was cooled in the air. The properties of the sintered alloy according to the present invention are shown in Table II.

COMPARATIVE EXAMPLE 1-2

Using elemental powders of varying amounts as shown in Table I, additional examples and comparative alloys were prepared by the method of Example 1. And the properties of these comparative examples are shown in Table II.

TABLE I

| alloying elements | Ex. 1 | Ex. 2 | Ex. 3 | Ex. 4 | Ex. 5 | Comp. Ex. 1 | Comp. Ex. 2 |
|---|---|---|---|---|---|---|---|
| C (graphite −100 Mesh) | 0.99 | 0.83 | 0.95 | 0.995 | 1.15 | 1.03 | 0.93 |
| Cr (Fe-12% Cr −100 Mesh) | 1.14 | 1.12 | 1.4 | 1.48 | 1.20 | 1.55 | 1.49 |
| Mo (metallic Mo −50 μm) | 1.88 | 1.79 | 1.93 | 1.93 | 1.66 | 2.05 | 1.14 |
| Mo (Fe-60% Mo. −100 Mesh) | 8.86 | 8.41 | 9.11 | 9.1 | 7.84 | 9.55 | 5.36 |
| Ni (metallic Ni, −200 Mesh) | 0.31 | 0.55 | 0.4 | 0.47 | 0.35 | 0.48 | — |
| Co (metallic Co, −50 μm) | 0.66 | 0.77 | 0.98 | 0.95 | 0.68 | 1.03 | — |
| Cu (Cu-4% Co. −100 Mesh) | 13.29 | 14.5 | 16.7 | 16.6 | 15.9 | 0.1 | 0.1 |
| S (Fe-0.83% S −100 Mesh) | 0.06 | 0.11 | 0.05 | 0.023 | 0.05 | 0.04 | 0.01 |

TABLE II

| | Ex. 1 | Ex. 2 | Ex. 3 | Ex. 4 | Ex. 5 | Comp. Ex. 1 | Comp. Ex. 2 |
|---|---|---|---|---|---|---|---|
| strength (Kg) | 332 | 331 | 339 | 334 | 328 | 193 | 161 |
| hardness (HV 10 Kg) | 376 | 355 | 351 | 365 | 357 | 217 | 205 |
| density (g/cm$^3$) | 7.81 | 7.75 | 7.82 | 7.78 | 7,90 | 6.83 | 6.84 |
| heat conductivity (Cal/Cm. °C. sec) | 9.863 | 10.147 | 10.737 | 10.696 | 10.444 | 4.501 | 4.309 |

TABLE II-continued

| | Ex. 1 | Ex. 2 | Ex. 3 | Ex. 4 | Ex. 5 | Comp. Ex. 1 | Comp. Ex. 2 |
|---|---|---|---|---|---|---|---|
| abrasion resistance (400 Hr. Engine) | 139μ | 232μ | 100μ | 177μ | 198μ | 559μ | 916μ |

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

WHAT IS CLAIMED IS:

1. A Fe-base sintered alloy for a valve seat for use in internal combustion engines, which consists essentially of 0.4 to 2% of C, 0.5 to 5% of Cr, 5 to 15% of Mo, 0.2 to 2% of Ni, 0.4 to 2% of Co, 8 to 20% of Cu, 0.01 to 0.5% of S, and the balance Fe, wherein percentages are by weight.

2. The Fe-base sintered ally of claim 1, wherein the C is derived from natural graphite, the Cr is from Fe-Cr alloy, the Mo is from Mo powder or Fe-Mo alloy, the Ni is metallic Ni, the Co is metallic Co, the Cu is from Co-Cu powder and the S is from Fe-S alloy.

3. A process for the preparation of Fe-base sintered alloy for a valve seat for use in internal combustion engines, which comprises:

mixing, by weight, powders of 0.4 to 2% of C, 0.5 to 5% of Cr, 5 to 15% of Mo, 0.2 to 2% of Ni, 0.4 to 2% of Co, 8 to 20% of Cu, 0.01 to 0.5% of S, and the balance Fe to produce a first mixture; compacting said first mixture to produce a green compact; sintering said green compact at a temperature of about 1,000° to 1,200° C.; and reheating sintered products for infiltration, cooling it in oil, heating it again and then cooling it in air to produce the alloy.

4. The process of claim 3, wherein the C is derived from natural graphite, the Cr is from Fe-Cr alloy, the Mo is from Mo powder or Fe-Mo alloy, the Ni is metallic Ni, the Co is metallic Co, the Cu is from Co-Cu powder and the S is from Fe-S alloy.

* * * * *